US008905518B2

(12) United States Patent
Ota

(10) Patent No.: US 8,905,518 B2
(45) Date of Patent: Dec. 9, 2014

(54) RECORDING APPARATUS INCLUDING A SUPPORTING MEMBER THAT SUPPORTS A CONNECTING MEMBER

(71) Applicant: Seiko Epson Corporation, Tokyo (JP)

(72) Inventor: Hidenobu Ota, Hara-mura (JP)

(73) Assignee: Seiko Epson Corporation, Tokyo (JP)

( * ) Notice: Subject to any disclaimer, the term of this patent is extended or adjusted under 35 U.S.C. 154(b) by 19 days.

(21) Appl. No.: 13/837,521

(22) Filed: Mar. 15, 2013

(65) Prior Publication Data

US 2013/0278674 A1 Oct. 24, 2013

(30) Foreign Application Priority Data

Apr. 19, 2012 (JP) ..... 2012-095853

(51) Int. Cl.
*B41J 23/00* (2006.01)
*B41J 11/00* (2006.01)
*B41J 19/00* (2006.01)

(52) U.S. Cl.
CPC ..... *B41J 11/008* (2013.01); *B41J 19/005* (2013.01)
USPC ..... 347/37; 347/20

(58) Field of Classification Search
USPC ..... 347/37, 50, 84–87, 94
See application file for complete search history.

(56) References Cited

U.S. PATENT DOCUMENTS

| | | | | |
|---|---|---|---|---|
| 5,054,944 | A * | 10/1991 | Matsuyama | 400/679 |
| 6,755,514 | B2 | 6/2004 | Koga | |
| 7,063,409 | B2 | 6/2006 | Koga | |
| 7,631,965 | B2 | 12/2009 | Samoto et al. | |
| 7,775,629 | B2 | 8/2010 | Nukui et al. | |
| 7,988,268 | B2 | 8/2011 | Morino | |

FOREIGN PATENT DOCUMENTS

| | | |
|---|---|---|
| JP | 63-264360 | 11/1988 |
| JP | 03-246039 | 11/1991 |
| JP | 10-226084 | 8/1998 |
| JP | 2000-318176 | 11/2000 |
| JP | 2001-171096 | 6/2001 |
| JP | 2005-186629 | 7/2005 |
| JP | 2005-329547 | 12/2005 |
| JP | 2006-123195 | 5/2006 |
| JP | 2006-205741 | 8/2006 |
| JP | 2006-231819 | 9/2006 |
| JP | 2007-176068 | 7/2007 |
| JP | 2008-049560 | 3/2008 |
| JP | 2009-023169 | 2/2009 |
| JP | 2010-240927 | 10/2010 |

* cited by examiner

*Primary Examiner* — Juanita D Jackson
(74) *Attorney, Agent, or Firm* — Workman Nydegger

(57) ABSTRACT

A recording apparatus that performs recording by a recording head mounted on a carriage capable of scanning on a recording medium, includes a connecting member of which both ends are connected to the recording head and an apparatus main body and that moves in a bending manner, and a plate-like supporting member that supports the connecting member at the lower side in the vertical direction. In the recording apparatus, one end of the supporting member is supported on a frame member of the apparatus main body in a cantilever manner.

5 Claims, 6 Drawing Sheets

RECORDING APPARATUS INCLUDING A SUPPORTING MEMBER THAT SUPPORTS A CONNECTING MEMBER

BACKGROUND

1. Technical Field

The present invention relates to a recording apparatus.

2. Related Art

As an existing ink jet recording apparatus, a so-called off-cartridge type ink jet recording apparatus in which an ink accommodation member provided in an ink cartridge is connected to a recording head provided on the lower surface of a carriage through an ink supply tube has been known. In the off-cartridge type recording apparatus, the recording head is mounted on the carriage and reciprocates. Therefore, for example, the ink supply tube and a flexible flat cable (connecting member) that connect the carriage and the recording apparatus main body move irregularly while following the reciprocation of the carriage in some cases. Then, a recording apparatus that restricts irregular movement of a plurality of ink tubes in the width direction of the flexible flat cable due to the reciprocation of the carriage has been known (for example, see JP-A-2006-205741). In the recording apparatus, a configuration in which a cable holder holding the flexible flat cable is fixed to a frame member so as to hold the flexible flat cable is employed.

However, in the above-mentioned existing technique, there arises the following problem. That is, the flexible flat cable that bends with the reciprocation motion of the carriage is fixed to the frame member, so that vibration with the bending motion of the flexible flat cable is transmitted to the frame. As a result, the vibration is undesirably transmitted to the carriage. The vibration of the carriage lowers landing accuracy of ink to be ejected from a recording head mounted on the carriage onto a recording medium and accordingly, desired recording quality cannot be obtained.

SUMMARY

An advantage of some aspects of the invention is to provide a recording apparatus that suppresses transmission of vibration to a carriage and makes it possible to obtain desired recording quality.

A recording apparatus according to an aspect of the invention that performs recording by a recording head mounted on a carriage capable of scanning on a recording medium, includes a connecting member of which both ends are connected to the recording head and an apparatus main body and that moves in a bending manner and a plate-like supporting member that supports the connecting member at the lower side in the vertical direction. In the recording apparatus, one end of the supporting member is supported on a frame member of the apparatus main body in a cantilever manner.

With the recording apparatus according to the aspect of the invention, when the connecting member that has moved on the supporting member in the bending manner vibrates, the vibration generated on the connecting member can be absorbed by the supporting member since the supporting member is supported on the frame member in the cantilever manner. Therefore, the vibration on the connecting member is prevented from being transmitted to the carriage and recording can be performed on the recording medium by the recording head with high accuracy.

Accordingly, desired recording quality can be obtained while suppressing transmission of the vibration to the carriage.

In the recording apparatus according to the aspect of the invention, it is preferable that the supporting member include a first supporting member and a second supporting member that are arranged at different positions in the vertical direction.

With this configuration, the connecting member that moves in the bending manner in accordance with the position of the recording head is supported by the first supporting member and the second supporting member preferably at different positions in the vertical direction. This makes it possible to suppress the transmission of the vibration on the connecting member that has moved in the bending manner with change in the position of the recording head to the carriage more reliably.

In the recording apparatus according to the aspect of the invention, it is preferable that the connecting member be connected to the recording head and the apparatus main body in a state of being bent such that one end and the other end of the connecting member are made to direct to opposite directions on a vertical plane, and one of the first supporting member and the second supporting member be arranged at the inner side of a region closed by the connecting member and the other of the first supporting member and the second supporting member be arranged at the outer side of the closed region.

With this configuration, the connecting member can be supported preferably in a mode in which the connecting member is bent such that one end and the other end of the connecting member are made to direct to opposite directions on the vertical plane. This makes it possible to suppress the transmission of the vibration on the connecting member that has moved in the bending manner with change in the position of the recording head to the carriage more reliably.

In the recording apparatus according to the aspect of the invention, it is preferable that a resonant frequency of the supporting member and a frequency of the connecting member that vibrates when the carriage scans have a relationship of non-integer multiple.

With this configuration, the resonant frequency of the supporting member and the frequency of the connecting member that vibrates when the carriage scans have a relationship of non-integer multiple. This makes it possible to prevent resonance of the supporting member with the connecting member that vibrates reliably.

In the recording apparatus according to the aspect of the invention, it is preferable that the connecting member be a long flexible wiring substrate that transmits an electric signal between a controller for controlling the recording head and the recording head.

With this configuration, the transmission of vibration on the flexible wiring substrate that moves in the bending manner to the carriage can be prevented. Therefore, desired recording quality can be obtained while suppressing the transmission of the vibration to the carriage.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
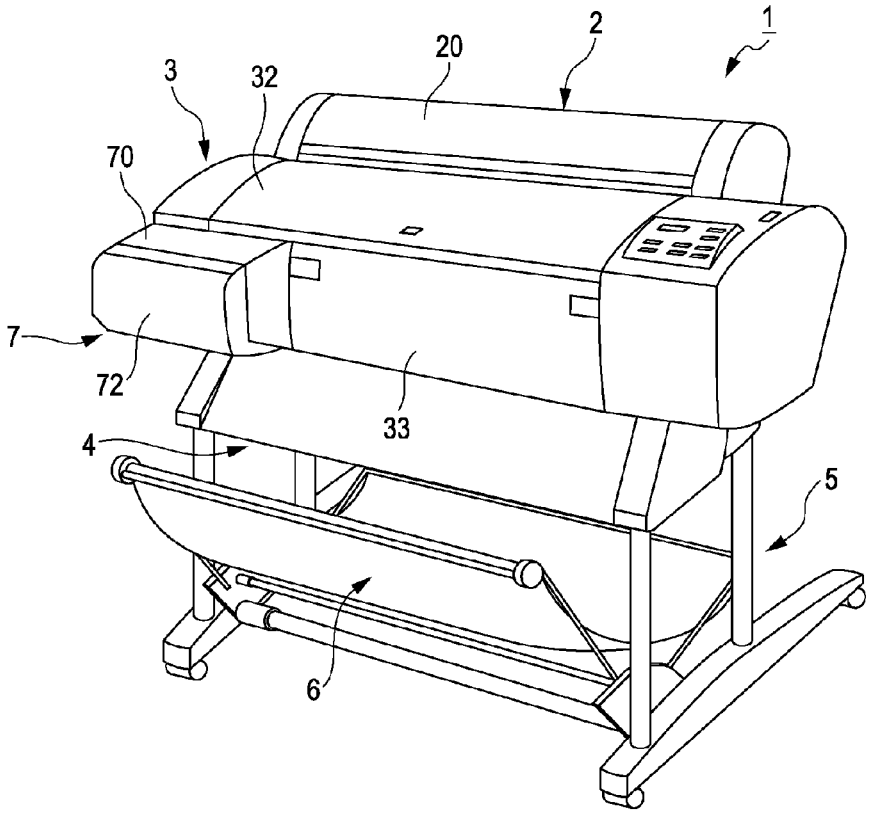
FIG. 1 is a view illustrating a perspective configuration of a printer according to an embodiment.

Hereinafter, an embodiment of the invention is described with reference to the drawings. In the drawings, the scales of various members are illustrated as being different from the actual scales in order to enable those members to be visible in the drawings. In the embodiment, a printing apparatus is applied to a large-sized printer that can perform printing on print paper having a paper width up to approximately A1 size or B1 size.

Figure 2:
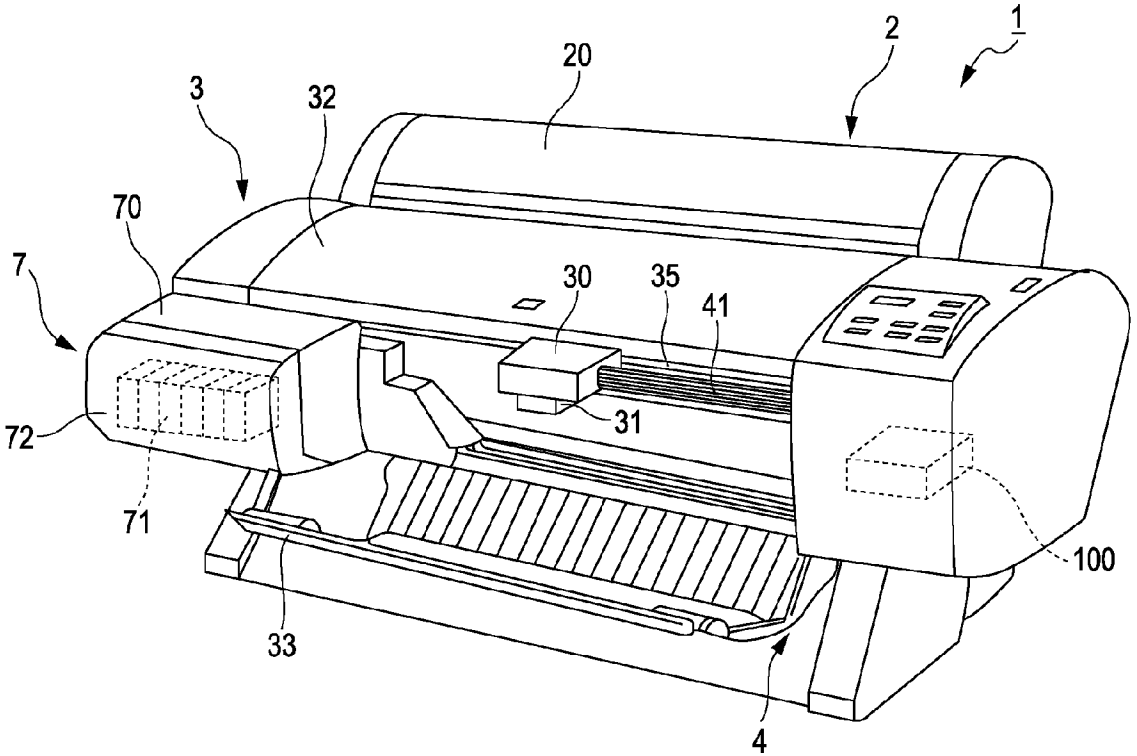
FIG. 2 is a perspective configuration view illustrating a state where a front lid of the printer is opened.

FIG. 1 is a view illustrating a perspective configuration of a printer according to the embodiment. FIG. 2 is a perspective configuration view illustrating a state where a front lid of the printer is opened.

A printer 1 incorporates a paper feeding portion 2, a printing portion 3, and a paper discharge portion 4 constituting a printer main body therein, and includes a leg device 5 and a discharged paper receiving device 6. The paper feeding portion 2 is provided on an upper rear portion of the printer 1 in a projecting manner and roll paper (recording medium) is set in the paper feeding portion 2. A roll paper cover 20 is attached to the paper feeding portion 2 so as to cover the roll paper in an opening/closing manner.

The printing portion 3 has an upper lid 32 and a front lid 33. The printing portion 3 includes a carriage 30 in a space partitioned by the upper lid 32 and the front lid 33. A printing head 31 is mounted on the carriage 30. Ink tubes 41 are connected to the printing head 31 mounted on the carriage 30. The printing head 31 is constituted by a so-called ink jet head on which a plurality of nozzles for discharging ink to be supplied through the ink tubes 41 are formed.

A lower portion of the front lid 33 that is located at the side of a paper transportation surface is supported on the apparatus main body in a rotationally movable manner. The carriage 30 is supported so as to be movable along a guide shaft 35 provided in the main scanning direction. If a carriage driving device (not illustrated) is operated, the carriage 30 reciprocates while being guided by the guide shaft 35.

Figure 3:
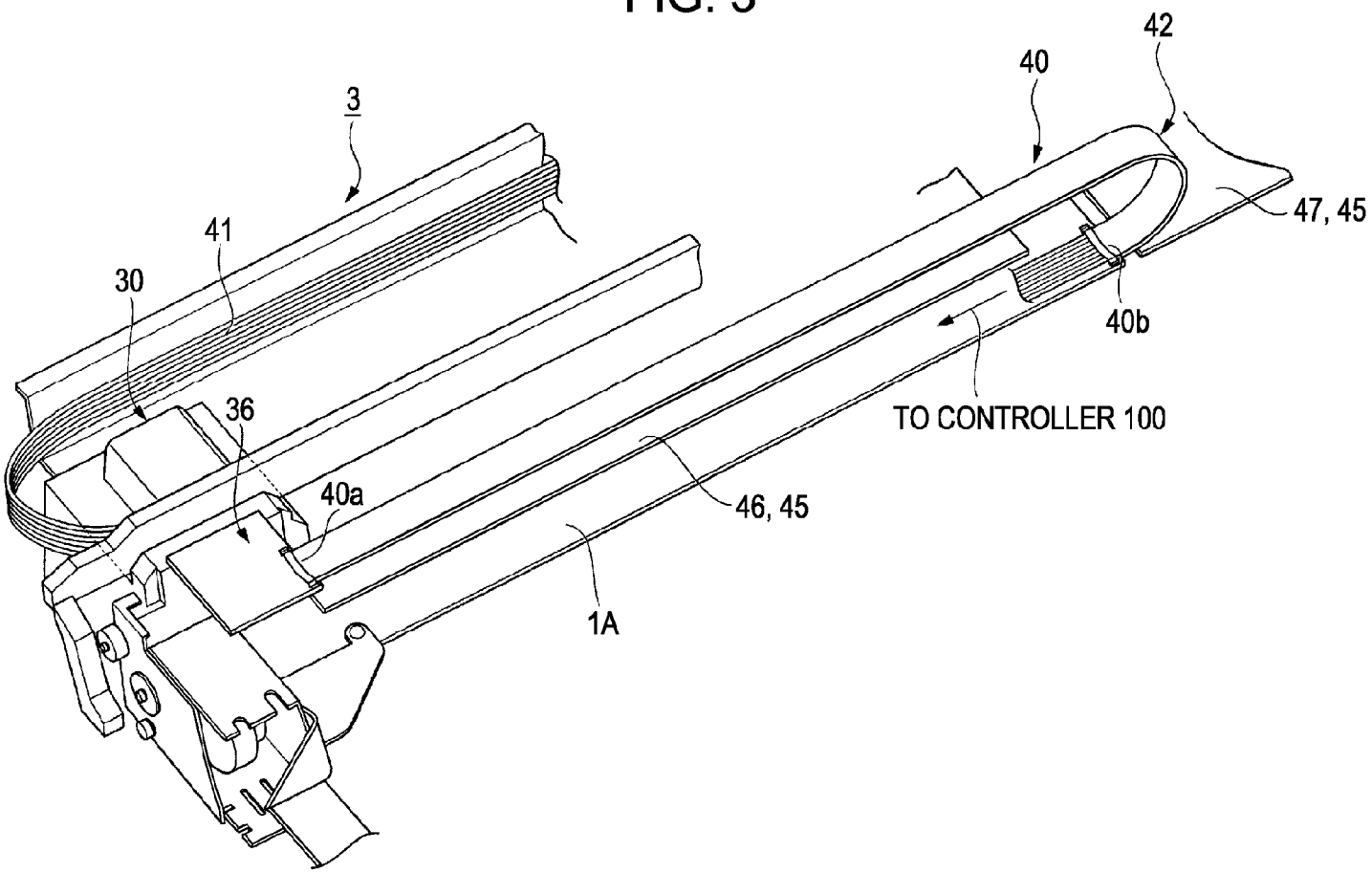
FIG. 3 is a view illustrating a configuration of main parts of a printing portion when seen from the rear surface side of the printer.

FIG. 3 is a view illustrating a configuration of main parts of the printing portion 3 when seen from the rear surface side of the printer 1. As illustrated in FIG. 3, the ink tubes 41 and a flat cable (connecting member) 40 for transmitting a print signal from a controller 100 (see FIG. 2) are connected to the carriage 30 and the printing head 31 mounted on the carriage 30. The flat cable 40 is constituted by a long flexible wiring substrate and wirings for transmitting various types of signals to the carriage 30 are formed on the flat cable 40. In the printer 1 according to the embodiment, one end of the flat cable 40 is connected to the printing head 31 and the other end thereof is connected to a connector of the controller 100 mounted on a housing portion (apparatus main body) 1A.

A cartridge holder 7 constituting an ink supply device is provided at the front side of the printing portion 3. Ink cartridges 71 of six colors (yellow, light magenta, light cyan, magenta, cyan, black) are accommodated in a holder main body 70 of the cartridge holder 7 horizontally so as to be inserted and removed from the front surface side of the printer 1.

A holder cover 72 covering the inserted ink cartridges 71 is provided on the holder main body 70 so as to be opened and closed. Inks of the respective colors are supplied to the printing head 31 through the ink tubes 41 and used for printing on print paper.

In print operations of the above-mentioned printer 1, printing is performed on roll paper fed from the paper feeding portion 2 on the printing portion 3 and the roll paper is discharged obliquely to the lower front side of the printer 1 through the paper discharge portion 4. A cutter (not illustrated) for cutting the roll paper is provided between the printing portion 3 and the paper discharge portion 4. When printing has been finished, the roll paper is cut by the cutter so as to be received by the discharged paper receiving device 6.

Returning to FIG. 3 again, ends of the ink tubes 41 are connected to the carriage 30. Further, the ink tubes 41 are folded back by 180° on halfway, so that the other ends of the ink tubes 41 are connected to the ink cartridges 71. That is to say, the ink tubes 41 are connected to the carriage 30 in a state of being bent on the horizontal plane.

In the same manner as the ink tubes 41, one end of the flat cable 40 is connected to the carriage 30. The flat cable 40 is arranged to lie along the scanning direction of the carriage 30, and then, is folded back by 180° on halfway, so that the other end of the flat cable 40 is connected to the printer main body. That is to say, the flat cable 40 is connected to the carriage 30 in a state of having a bending portion 42 bent on the vertical plane as illustrated in FIG. 3.

With this configuration, the flat cable 40 can be bent easily by setting the bending direction of the bending portion 42 to the vertical direction in which the flat cable 40 is easy to be deflected due to the weight of the flat cable 40 itself. Therefore, the bending property of the flat cable 40 connected to the printing head 31 is improved, thereby executing scanning of the carriage 30 smoothly.

Meanwhile, the flat cable 40 and the ink tubes 41 connected to the carriage 30 are made to move while following the reciprocation motion of the carriage 30 along the guide shaft 35. Accordingly, each of the flat cable 40 and the ink tubes 41 will move irregularly in some cases.

In particular, vibration in the up-down direction is easy to be generated on the flat cable 40 with the movement of the carriage 30 since the bending direction of the bending portion 42 is set to the vertical direction as described above. The vibration generated on the flat cable 40 may be possibly transmitted to the carriage 30 to which the flat cable 40 is connected. If the vibration is transmitted to the carriage 30, there is a risk that ink landing accuracy from the printing head 31 mounted on the carriage 30 on the roll paper is lowered and the desired print quality cannot be obtained.

To be more specific, when the printing head 31 is located at the left end (so-called home position) of the guide shaft 35, as illustrated in FIG. 3, the bending portion 42 is located at a position in the vicinity of the other end portion 40*b* of the flat cable 40 fixed to the housing portion 1A. It is to be noted that when the printing head 31 does not perform printing processing, the home position indicates a position at which the printing head 31 stands by, for example, when driving of the printer 1 is started.

At this time, a length from a one end portion 40*a* to the bending portion 42 on the flat cable 40 is extended. Therefore, a portion of the flat cable 40, which is connected to the upper end of the bending portion 42, droops downward due to the weight of the flat cable 40 itself.

Further, when the printing head 31 is moved to the right end of the guide shaft 35 from the state as illustrated in FIG. 3, the bending portion 42 is made closer to the carriage 30 gradually with the movement of the carriage 30 since the other end portion 40*b* of the flat cable 40 is fixed to the housing portion 1A and a position thereof is restrained. At this time, a length from the other end portion 40*b* to the bending portion 42 on the flat cable 40 is extended. Therefore, a portion of the flat cable 40, which is connected to the lower end of the bending portion 42, droops downward due to the weight of the flat cable 40 itself.

In this manner, in the printer 1, a drooping position of the flat cable 40 changes with the position of the carriage 30 that reciprocates along the guide shaft 30. Accordingly, vibration in the up-down direction is easy to be generated on the flat cable 40 with the movement of the carriage 30 as described above and the likelihood that the vibration of the flat cable 40 is transmitted to the carriage 30 becomes high.

In view of this, the printer 1 according to the embodiment tries to prevent the vibration of the flat cable 40 from being transmitted to the carriage 30. To be more specific, the printer 1 includes a supporting plate (supporting member) 45 having a supporting portion that supports the flat cable 40 at the lower side in the vertical direction. The supporting plate 45 includes a first supporting plate (first supporting member) 46 and a second supporting plate (second supporting member) 47.

Figure 4:
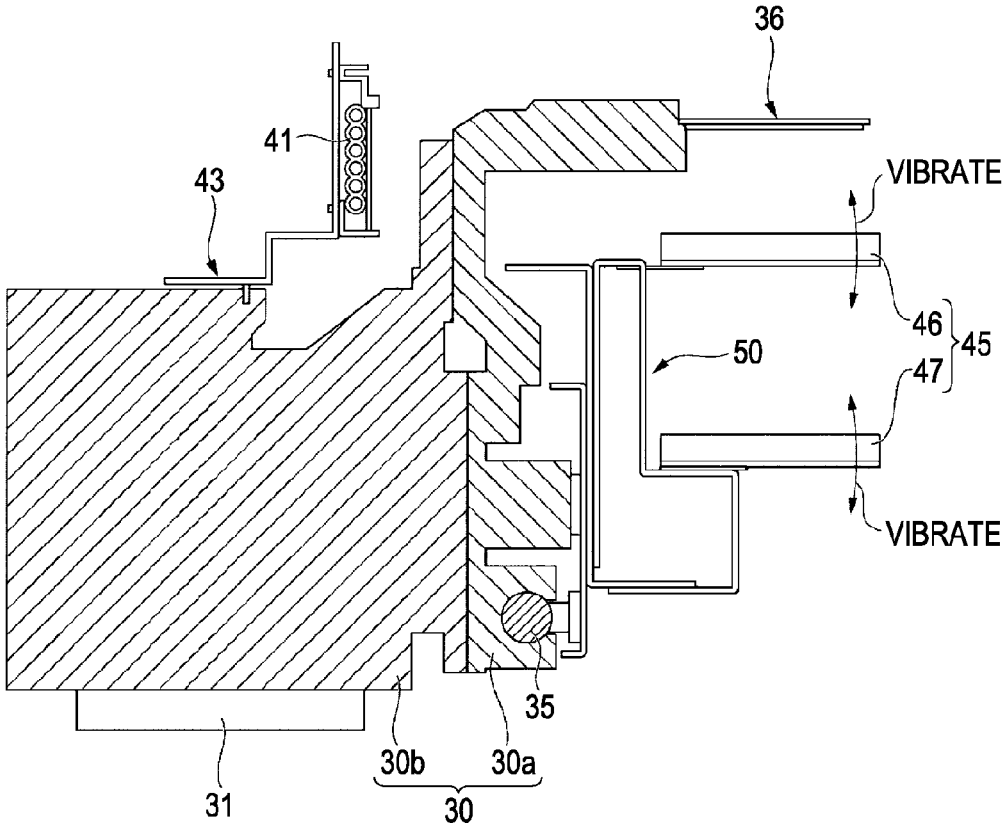
FIG. 4 is a cross-sectional view illustrating a configuration of main parts around a carriage.
Figure 5:
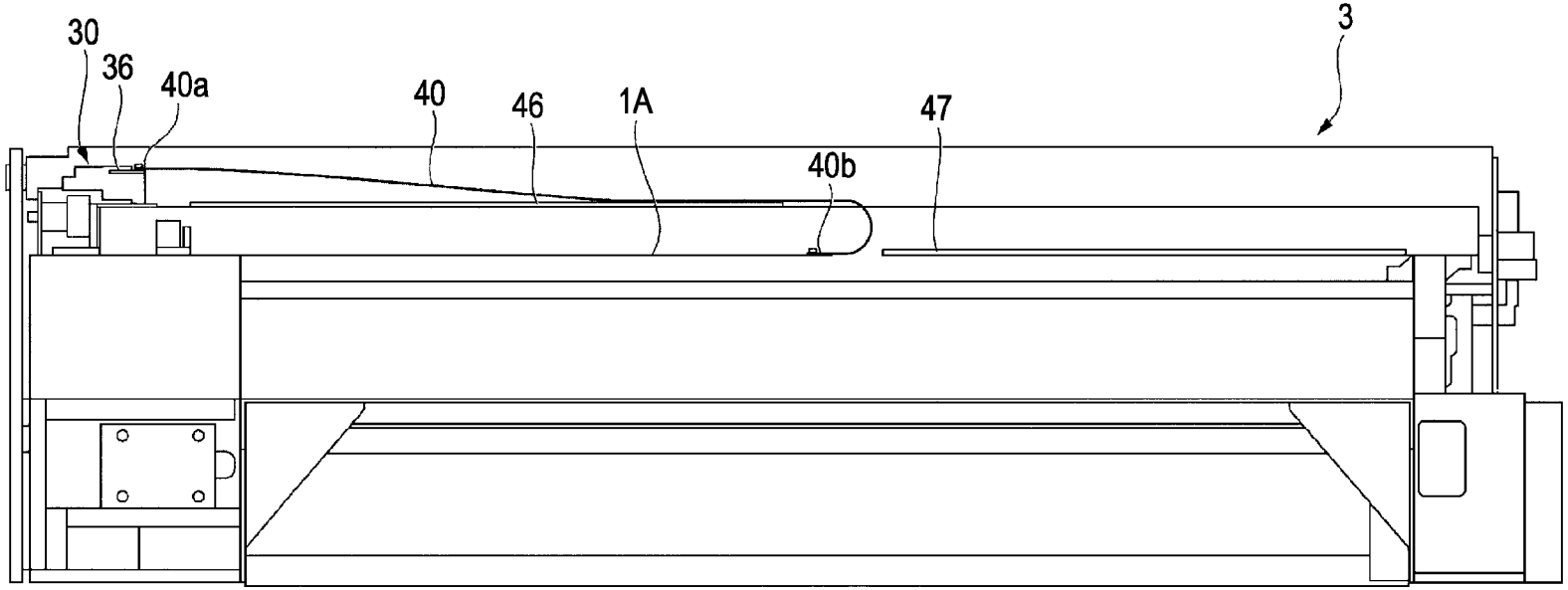
FIG. 5 is a rear view illustrating a configuration of main parts of the printer.

FIG. 4 is a cross-sectional view illustrating a configuration of main parts around the carriage 30. FIG. 5 is a rear view illustrating a configuration of main parts of the printer 1.

As illustrated in FIG. 4, the carriage 30 includes a main carriage 30*a* and a sub carriage 30*b*. The main carriage 30*a* moves along the guide shaft 35 provided on a main frame (frame member) 50. The sub carriage 30*b* is attached to the main carriage 30*a*. The printing head 31 is arranged on the lower portion of the sub carriage 30*b*. A cable fixing portion 36 is attached to the main carriage 30*a* in a state of jutting on an upper portion thereof. The cable fixing portion 36 is a portion for fixing the one end portion 40*a* of the flat cable 40 as will be described later. Further, a tube fixing portion 43 is attached to the upper portion of the sub carriage 30*b*. The tube fixing portion 43 is a portion for fixing the ink tubes 41 through which ink is supplied to the printing head 31.

The above-mentioned first supporting plate 46 and second supporting plate 47 are attached to the main frame 50. The main frame 50 is attached to the housing portion 1A.

To be more specific, in the embodiment, the first supporting plate 46 and the second supporting plate 47 are supported on the main frame 50 in a cantilever manner. It is to be noted that the entire side surfaces of the first supporting plate 46 and the second supporting plate 47 are not required to be fixed to the main frame 50 and a part (for example, end portions at the center side of the guide shaft 35) of the side surfaces may not be fixed to the main frame 50. With this configuration, the first supporting plate 46 and the second supporting plate 47 are not fixed to the main frame 50 at the center side of the guide shaft 35 at which the flat cable 40 is easy to droop at the largest level with the reciprocation motion of the carriage 30. Therefore, the first supporting plate 46 and the second supporting plate 47 can be made to easily vibrate with respect to the main frame 50.

As illustrated in FIG. 5, the first supporting plate 46 and the second supporting plate 47 are attached to the main frame 50 in a state of being located at different positions in the lengthwise direction of the guide shaft 35. To be more specific, the first supporting plate 46 is arranged at a position closer to the home position in a region on which the printing head 31 reciprocates. On the other hand, the second supporting plate 47 is arranged at a position distanced from the home position.

Further, the first supporting plate 46 and the second supporting plate 47 are arranged at different positions in the vertical direction. To be more specific, the first supporting plate 46 is arranged at the upper side relative to the second supporting plate 47 in the vertical direction.

In the embodiment, one end of the flat cable 40 is connected to the carriage 30. Further, the flat cable 40 is arranged to lie along the scanning direction of the carriage 30, and then, is folded back by 180° on halfway. With this, the flat cable 40 has the bending portion 42 formed by the one end portion 40*a* and the other end portion 40*b* being directed to opposite directions with each other.

Therefore, the first supporting plate 46 arranged at the side of the home position is arranged at the inner side of a region A closed by the flat cable 40 and the second supporting plate 47 is arranged at the outer side of the region A.

The first supporting plate 46 is set to have a length shorter than half of the dimension of the region on which the carriage 30 moves, that is, half of the dimension of the guide shaft 35. With this configuration, even when the carriage 30 is located at the home position and the position of the bending portion 42 becomes closest to the first supporting plate 46, the bending portion 42 (flat cable 40) and the first supporting plate 46 are prevented from making contact with each other. Therefore, the first supporting plate 46 does not inhibit the reciprocating motion of the flat cable 40.

A resonant frequency of each of the first supporting plate 46 and the second supporting plate 47 and a frequency of the flat cable 40 that vibrates when the carriage 30 scans have a relationship of non-integer multiple. Accordingly, as a constituent material of each of the first supporting plate 46 and the second supporting plate 47, a material that has predetermined rigidity and of which resonant frequency can satisfy the above-mentioned relationship is required to be used. By using such material, the resonance of the supporting plate 45 with the flat cable 40 that vibrates when the carriage 30 scans can be prevented reliably.

Based on the configuration, the first supporting plate 46 can support the flat cable 40 (portion thereof which is connected to the upper end of the bending portion 42) that droops downward due to the weight of the flat cable 40 itself at the lower side in the vertical direction when the carriage 30 is located at a position in the vicinity of the home position.

Further, the second supporting plate 47 can support the flat cable 40 (portion thereof which is connected to the lower side of the bending portion 42) that droops downward due to the weight of the flat cable 40 itself at the lower side in the vertical direction when the carriage 30 is located at a position distanced from the home position.

Figure 6A:
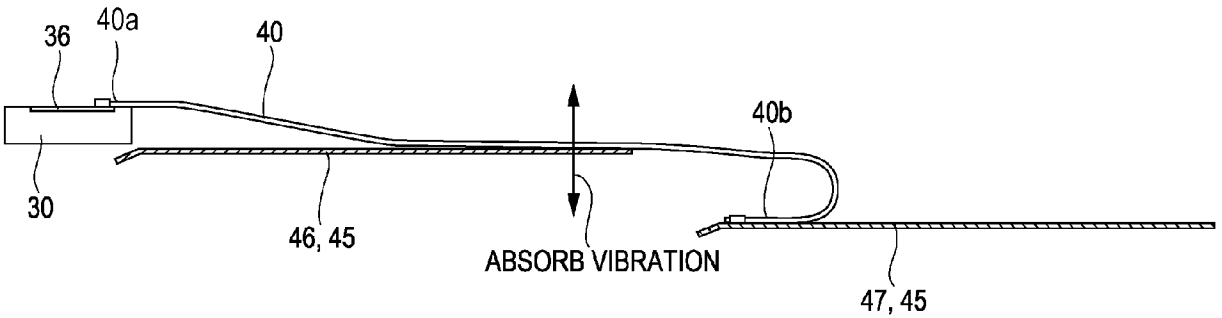
FIGS. 6A and 6B are views for explaining an effect by a supporting plate.
Figure 6B:
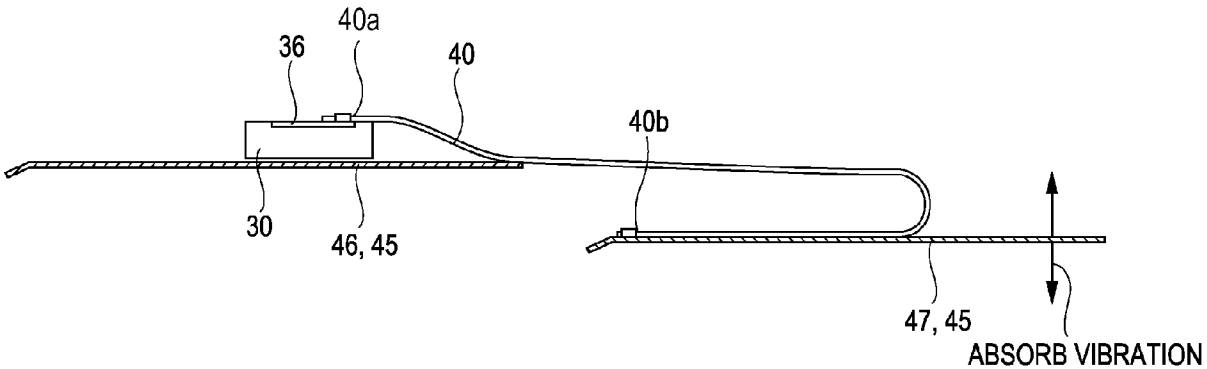

Then, operations of the printer 1 are described. In the following description, operations of the carriage 30 at the time of the printing processing during which the effect by the supporting plate 45 as the characteristic portion of the printer 1 according to the embodiment is obtained are described mainly. FIGS. 6A and 6B are views for explaining the effect by the supporting plate 45. FIG. 6A is a view illustrating a case where the carriage 30 is located at the position in the vicinity of the home position and FIG. 6B is a view illustrating a case where the carriage 30 is located at the position distanced from the home position.

When the printer 1 performs the printing processing, the controller 100 causes the printing head 31 to drive and discharge ink on the roll paper to be supplied by the paper feeding portion 2. The controller 100 operates the carriage driving device during the printing processing and causes the carriage 30 to scan along the guide shaft 35 so as to discharge ink on the overall region of the roll paper in the width direction.

As illustrated in FIG. 3, the one end portion 40*a* of the flat cable 40 is fixed to the cable fixing portion 36 of the carriage 30. Therefore, the position of the one end portion 40*a* relative to the other end portion 40*b* held on the housing portion (apparatus main body) 1A changes with the movement of the carriage 30 at the time of the printing processing. The flat cable 40 according to the embodiment is folded back by 180° on halfway, so that the position of the bending portion 42 changes with the movement of the carriage 30.

For example, when the carriage 30 is located at the position in the vicinity of the home position, as illustrated in FIG. 6A, the flat cable 40 (portion thereof which is connected to the upper end of the bending portion 42) is made into a state of drooping downward due to the weight of the flat cable 40 itself. The flat cable 40 that droops downward in this manner is supported in such a manner that the lower portion thereof in the vertical direction abuts against the first supporting plate 46.

On the other hand, when the carriage 30 is located at the position distanced from the home position, as illustrated in FIG. 6B, the flat cable 40 (portion thereof which is connected to the lower side of the bending portion 42) is made into a state of drooping downward due to the weight of the flat cable 40 itself. The flat cable 40 that droops downward in this manner is supported in such a manner that the lower portion thereof in the vertical direction abuts against the second supporting plate 47.

The first supporting plate 46 and the second supporting plate 47 according to the embodiment are supported on the main frame 50 in the cantilever manner. Therefore, the first supporting plate 46 and the second supporting plate 47 vibrate preferably when they support the flat cable 40 that moves in the up-down direction with the reciprocation operation of the carriage 30.

The resonant frequency of each of the first supporting plate 46 and the second supporting plate 47 and the vibration frequency of the flat cable 40 have a relationship of non-integer multiple. Therefore, the resonance of the supporting plate 45 with the flat cable 40 that vibrates when the carriage 30 scans can be prevented.

Therefore, the first supporting plate 46 and the second supporting plate 47 vibrate to absorb the vibration of the flat cable 40 preferably, thereby preventing the vibration from being transmitted to the carriage 30.

As described above, with the printer 1 according to the embodiment, the vibration is prevented from being transmitted to the carriage 30. Accordingly, ink can be discharged on the roll paper from the printing head 31 mounted on the carriage 30 with high accuracy, thereby capable of obtaining desired print quality.

It is to be noted that the invention is not limited to the configuration according to the above-mentioned embodiment and can be changed appropriately in a range without departing from the scope of the invention.

For example, in the above-mentioned embodiment, the flat cable 40 has been described as the connecting member of which both ends are connected to the printing head 31 and the main body of the printer 1, as an example. However, the invention is not limited thereto. To be more specific, the ink tubes 41 of which both ends are connected to the printing head 31 and the ink cartridges 71 provided on the main body of the printer 1 may be set as the connecting member and the supporting plate 45 may be arranged so as to support the ink tubes 41 at the lower side in the vertical direction.

In the above-mentioned embodiment, the ink tubes 41 are connected to the carriage 30 in a state of being bent on the horizontal plane as illustrated in FIG. 3. However, in the above-mentioned case, it is preferable that the ink tubes 41 be bent on the vertical plane in the same manner as the flat cable 40.

If the ink tubes 41 are bent on the vertical plane in this manner, the ink tubes 41 become easy to be deflected by their own weights. Therefore, vibration is easy to be generated on the ink tubes 41 with the movement of the carriage 30 but can be absorbed preferably with the effect by the supporting plate 45.

The entire disclosure of Japanese Patent Application No. 2012-095853, filed Apr. 19, 2012 is expressly incorporated by reference herein.

What is claimed is:

1. A recording apparatus that performs recording by a recording head mounted on a carriage capable of scanning on a recording medium, comprising:

a connecting member having a first end connected to the recording head and a second end connected to an apparatus main body and that moves in a bending manner, and a plate-like supporting member that supports the connecting member at the lower side in the vertical direction, wherein one end of the supporting member is supported on a frame member of the apparatus main body in a cantilever manner.

2. The recording apparatus according to claim 1, wherein the supporting member includes a first supporting member and a second supporting member that are arranged at different positions in the vertical direction.

3. The recording apparatus according to claim 1, wherein the connecting member is connected to the recording head and the apparatus main body in a state of being bent such that one end and the other end of the connecting member are made to direct to opposite directions on a vertical plane, and one of the first supporting member and the second supporting member is arranged at the inner side of a region closed by the connecting member and the other of the first supporting member and the second supporting member is arranged at the outer side of the closed region.

4. The recording apparatus according to claim 1, wherein a resonant frequency of the supporting member and a frequency of the connecting member that vibrates when the carriage scans have a relationship of non-integer multiple.

5. The recording apparatus according to claim 1, wherein the connecting member is a long flexible wiring substrate that transmits an electric signal between the recording head and a controller that controls the recording head.

* * * * *